US006703057B2

(12) United States Patent
Duffett

(10) Patent No.: US 6,703,057 B2
(45) Date of Patent: Mar. 9, 2004

(54) GRANULATED SUGAR PRODUCT

(75) Inventor: William Duffett, Knaresborough (GB)

(73) Assignee: Parnova Enterprises Limited, London (GB)

( * ) Notice: Subject to any disclaimer, the term of this patent is extended or adjusted under 35 U.S.C. 154(b) by 332 days.

(21) Appl. No.: 09/751,202

(22) Filed: Dec. 29, 2000

(65) Prior Publication Data

US 2001/0002271 A1 May 31, 2001

Related U.S. Application Data

(63) Continuation-in-part of application No. 09/214,637, filed as application No. PCT/GB97/01929 on Jul. 14, 1997, now abandoned.

(30) Foreign Application Priority Data

Jul. 13, 1996 (GB) ..... 9614759

(51) Int. Cl.[7] ..... C13F 3/00
(52) U.S. Cl. ..... 426/103; 127/30
(58) Field of Search ..... 426/103, 548, 426/295; 127/14, 21, 30, 63

(56) References Cited

U.S. PATENT DOCUMENTS 4,651,715 A * 3/1987 Breithaupt et al. ..... 127/61
4,746,520 A * 5/1988 Smits et al. ..... 426/103
4,906,423 A * 3/1990 Frisch ..... 264/48
5,401,519 A * 3/1995 Sabase et al. ..... 426/96
5,549,757 A * 8/1996 Morano ..... 127/42

FOREIGN PATENT DOCUMENTS

GB 2 026 881 * 2/1980

* cited by examiner

*Primary Examiner*—Keith Hendricks
(74) *Attorney, Agent, or Firm*—Chapman and Cutler LLP

(57) ABSTRACT

A granulated sugar product comprising a core material substantially of a granulated first sugar material having a density in the range of 0.60–1.20 g/cm$^3$, preferably 0.70–1.10 g/cm$^3$, and a surface material substantially of a second sugar material having a density preferably in the range of 0.01–0.55 g/cm$^3$, wherein the surface material comprises substantially a second sugar, dextrins, sorbitol, mannitol, starch, cellulose, inulin, glycogen, xylitol, levoglucason or maltol (and ethyl derivative). The surface material may cover only some or all of the surface of the first sugar granule. The product may also incorporate a sweetener, preferably a high intensity sweetener. The resulting granulated sugar product has an overall bulk density in the range of 0.10–0.65 g/cm$^3$ before packing. Following packing, the overall bulk density of the granulated sugar product is preferably in the range of 0.20–0.90 g/cm$^3$, which is lower than the bulk density of the granulated first sugar and, therefore, act as a lighter alternative to the first sugar product whilst maintaining the granulated form and "crunch." Furthermore, by the use of appropriate quantities of sweeteners, a lighter product with the same sweetness as the first sugar may be obtained. The reduction in calories per unit volume of the granulated sugar product with respect to traditional sugar is in the range of 5–60%,

23 Claims, 1 Drawing Sheet

GRANULATED SUGAR PRODUCT

This application is a continuation-in-part of a pending U.S. application Ser. No. 09/214,637 filed Jan. 6, 1999, now abandoned which is a 35 U.S.C §371 national stage of International Application No. PCT/GB97/01929 filed on Jul. 14, 1997.

BACKGROUND OF THE INVENTION

1. Field of the Invention

The present invention relates to a granulated sugar product and a process for making such a product and, in particular, to a product intended to be used as a substitute for granulated sugar.

2. Description of the Prior Art

Many and varied attempts have been made over a number of years to produce a granulated sugar product with similar appearance to sugar, the same sweetness and half the bulk density. The product should, when dispensed by a variety of measures eg., spoons, deliver less, preferably, only half or less, of the weight for the same sweetness when compared with granulated sugar. The product should also exhibit the "crunch" and reflective appearance of granulated sugar.

The present invention has been made from a consideration of this problem and in order to provide a granulated sugar product having one or more of the above-mentioned characteristics.

SUMMARY OF THE INVENTION

According to one aspect of the invention there is provided a granulated sugar product comprising a core material substantially of a granulated first sugar material and a surface material substantially of a second sugar material, wherein the second sugar material is less dense than the first sugar material and wherein the density of the first sugar material is in the range of 0.60–1.20 g/cm$^3$ and wherein the density of the second sugar material is in the range of 0.01–0.55 g/cm$^3$, and wherein the surface material comprises substantially a second sugar, dextrins, sorbitol, mannitol, starch, cellulose, inulin, glycogen, xylitol, levoglucason or maltol (and ethyl derivative).

The density of the first sugar material is preferably in the range of 0.70–1.10 g/cm$^3$, more preferably, in the range of 0.75–1.05 g/cm$^3$, even more preferably, in the range of 0.80–1.00 g/cm$^3$, and most preferably, in the range of 0.85–0.95 g/cm$^3$.

The density of the second sugar material is preferably in the range of 0.02–0.50 g/cm$^3$, more preferably, in the range of 0.04–0.40 g/cm$^3$, even more preferably, in the range of 0.05–0.35 g/cm$^3$, still more preferably, in the range of 0.05–0.30 g/cm$^3$, and most preferably, in the range of 0.10–0.20 g/cm$^3$.

The surface material may cover only some or all of the surface of the first sugar granule. The product may also incorporate a sweetener, preferably a high intensity sweetener.

In this manner, a granulated sugar product can be provided with an overall bulk density less than the bulk density of the granulated first sugar and, therefore, act as a lighter alternative to the first sugar product whilst maintaining the granulated form and "crunch." Furthermore, by the use of appropriate quantities of sweeteners, a lighter product with the same sweetness as the first sugar may be obtained.

The overall bulk density of the granulated sugar product before packing is preferably in the range of 0.10–0.65 g/cm$^3$, more preferably, in the range of 0.15–0.55 g/cm$^3$, even more preferably, in the range of 0.20–0.50 g/cm$^3$, and most preferably, in the range of 0.25–0.45 g/cm$^3$. Following packing, the overall bulk density of the granulated sugar product is preferably in the range of 0.20–0.90 g/cm$^3$, more preferably, in the range of 0.30–0.80 g/cm$^3$, even more preferably, in the range of 0.40–0.70 g/cm$^3$, and most preferably, in the range of 0.44–0.60 g/cm$^3$.

The reduction in calories per unit volume of the granulated sugar product with respect to traditional sugar is preferably in the range of 5–60%, more preferably, in the range of 10–50%, even more preferably, in the range of 15–40%, and most preferably, in the range of 20–30%.

Preferably, the first sugar is sucrose but any granulated sugar product may be used. By granulated is meant such products as would include, for instance, commercial table sugar and caster sugar but not icing sugar. Thus, typically granulated may imply having crystals of at least 0.1 mm or between about 0.1 mm and 1.0 mm, more preferably 0.2 mm and 0.8 mm and including specifically caster sugar having crystals in the range 0.27 to 0.34 mm and conventional granulated or table sugar having crystals in the range 0.60 to 0.67 mm. Preferably, the crystal sizes are in the range 0.27 mm to 0.67 mm.

The second sugar may be selected from any sugar product. Preferably, it may be selected from sucrose, glucose (dextrose, anhydrous & mono), fructose, lactose (anhydrous and hydrated), maltose, Ribose, galactose, dried glucose syrups, grape sugar, arabinose, raffinose, mannose, rhaimnose, iso-maltose, gentobiose, trehalose, cellobiose, neohesperidose, maltotriose, parose, neokestose, stachyose.

The sweetener may be any sweetener. Preferably, the sweetener is selected from sorbitol (E420), mannitol (E421), isomalt (E953), maltitol (E965), lactitol (E966), xylitol (E967), acesulfame K (E950), aspartame (E951), cyclamic acid and sodium and calcium salts (E952), saccharin and its sodium, potassium and calcium salts (E954), thaumatin (E957), neohesperidine DC (E959).

More preferably, the sweetener is aspartame and/or acesulfame K and/or other high intensity sweeteners. The high intensity of the sweetener is defined in terms of its sweetness compared with sugar on a weight basis. Preferably, the high intensity sweetener is at least 30 times, typically 200/300 times or at least 100 times, as sweet as sugar on a weight basis. Preferably, the product comprises two sweeteners, typically both aspartame and acesulfame K. In general aspartame tastes good but tends not to be heat stable whereas acesulfame K is heat stable but does not taste good. The product may include a liquid component such as water. The amount of added liquid typically determines the consistency of the mixture. Preferably, the surface material is in a powder form. More preferably, the surface material comprises a foam dried material.

Preferably, a surface material having a lower calorific density compared with sucrose is used. The lower calorific density may be due to the chemical or physical form of the surface material or both. Preferably, a low density maltodextrin is used. Preferably, the maltodextrin is in power form and most preferably the maltodextrin comprises foam dried maltodextrin. Foam drying is a know process comprising pumping gas under pressure into the feed to spray drier prior to the sugar being spray dried. Foam dried sugar has a honeycomb effect which gives it a significantly reduced bulk density. Thus, preferably a sugar that is fluffy and light is used.

Preferably, the product comprises the first sugar in the range of 60–90% by weight, more preferably, 75–85% by weight. Preferably, the surface material is 10–40% by weight, more preferably, 15–25% by weight. Preferably, the sweetener, typically aspartame and/or acesulfame K, is 0.1–1.0% by weight, more preferably, 0.1–0.5% by weight. Preferably, about 0.4% sweetener or about 0.2% each of aspartame and acesulfame K is used. Preferably about 0.18 to 0.22% each of aspartame and acesulfame K is used.

According to a second aspect of the invention there is provided a method of producing a granulated sugar product comprising mixing a core material of a granulated first sugar and a surface material in such a manner as to result in agglomeration of the mixture, wherein the surface material is less dense than the first sugar material and wherein the surface material comprises substantially a second sugar, dextrins, sorbitol, mannitol, starch, cellulose, inulin, glycogen, xylitol, levoglucason or maltol (and ethyl derivative). Preferably, the components of the mixture are as described above with respect to the first aspect of the invention. Preferably, the mixing is by means of a low shear mixer or slow speed blender. Alternatively, a batch or continuous agglomerator may be used. Preferably, liquid, typically water, is added to the mixture during mixing. The liquid may be added by spraying atomised liquid onto the mixture. Advantageously, the liquid turns the mixture into a slurry, but, preferably, does not dissolve the majority of the granulated first sugar or, preferably, the majority of the surface material although the liquid will, inevitably, dissolve some of the sugars. Advantageously dissolving a small amount of the sugars, the liquid, once dried, has the effect of encouraging the first sugar and the surface material to agglomerate thus producing larger granules with lower bulk density than the first sugar. Preferably, the liquid is water but any liquid able to solubilise sugars may be used. Preferably, the liquid is non-toxic and is easily evaporated. Preferably, 0.05–5% of liquid by weight, typically, water, is used, more preferably, 1.0–2.0% by weight is used.

Preferably, the mixture is mixed in a low shear mixer and a small amount of liquid, typically water, is added. As a specific example. 50 ml to 3.0 liters water may be added to an approximately 60 kg mixture. This results in the even and permanent agglomeration of the mixture with all of or some of the aforementioned characteristics. The low shear mixer may be of any suitable type such as drum types, tote blenders or slow speed blenders.

Alternatively, the mixture may be added to a batch or continuous agglomerator such as a fluidised bed agglomerator. Such an agglomerator may comprise a vessel having an air distribution grate at a lower end thereof. One or more filters may be positioned at an upper end of the vessel to filter out entrained solids. Nozzles for spraying atomised liquids, typically water. may be positioned in, on or adjacent to the vessel, for example in the sides or top of the vessel. Preferably, a small amount of sugar is added to the liquid or water in either embodiment before it enters the mixer or agglomerator as it has been found that this gives better results.

The method comprises mixing using a mixing machine, such as described in U.S. Pat. No. 4,278,355, which is incorporated herewith by reference. Thus, preferably the method comprises mixing by means of a mixing machine in which the components of the mixture are mixed by means of two counter rotating shafts with blades, where some of the blades have different angles of incidence and different blade areas in order to obtain a good mixing of the components.

Preferably, the mixing machine comprises a mixing chamber in which two shafts are arranged in substantially the same horizontal plane, the shafts being provided with blades or paddles disposed at an angle to and parallel with the shafts, the shafts rotating in opposite directions. Although the machine may be operated as described in U.S. Pat. No. 4,278,355 with reference to FIG. 4 thereof, it is preferred that the machine is operated such that downward movements are on the side where the shafts turn toward one another.

Preferably, the mixing machine is operated such that the blades have a peripheral rotational velocity of at least 1.2 m/sec or between 1.2 and 1.8 m/sec. A plurality of opposing pairs of blades of certain area are mounted on each shaft, positioned 90° transverse of the centerline for the shafts and with the blade wings disposed at a 45° angle in relation to the shaft centreline. The supports for the blade wings of some opposing pairs of blades may be displaced 90° in relation to the supports for other pairs as specifically described in U.S. Pat. No. 4,278,355. Other specific features of the machine, such as the disposition and form of the blades at the ends of the shafts, may be as described in U.S. Pat. No. 4,278,355. As previously mentioned it is preferred that the machine is operated conversely to the operation described in U.S. Pat. No. 4,278,355 in that the shafts are rotated in contra-rotation with downward movement of the shafts being on the side where the shafts turn towards each other. This allows the mixing to take place towards the lower region of the chamber, that is below the level of the shafts. It has been found that such operation gives surprisingly better results.

According to a third aspect of the invention there is provided a method of producing a granulated sugar product comprising the steps of:

(i) adding a core material substantially of a granulated first sugar, and a surface material to a low shear mixer or slow speed blender having at least two driving shafts, the shafts being provided with blades arranged at an angle to and parallel with the shafts, wherein the surface material is less dense than the first sugar material and wherein the surface material comprises substantially a second sugar, dextrins, sorbitol, mannitol, starch, cellulose, inulin, glycogen, xylitol, levoglucason or maltol (and ethyl derivative); and (ii) operating the mixer or blender such that the shafts rotate in opposite directions.

Preferably, the shafts of the mixer or blender are disposed in substantially the same horizontal plane and preferably the mixer or blender is operated such that downward movement of the shafts is on the side where the shafts turn toward one another.

Preferably, the mix or blender is as described in U.S. Pat. No. 4,278,355 with reference to FIGS. 1 to 3 thereof and/or as described above.

The method may include adding sweetener, liquid or other method steps described herein. The surface material, sugars and sweeteners may be as aforedescribed herein.

The invention further includes a method of producing a granulated sugar product of the invention and a product produced by means of a method of the invention.

According to a further aspect of the present invention there is provided a granulated sugar product comprising a mixture of granulated sugar, maltodextrin and high intensity sweetener. Preferably the product is crystalline. Preferably, the sweetener is as described above. Preferably, the product comprises two sweeteners, typically both aspartame and acesulfame K. The product may include a liquid component such as water. The amount of added liquid typically determines the consistency of the mixture. Preferably, a low density maltodextrin is used. Preferably, the maltodextrin is in powder form and most preferably, the maltodextrin comprises foam dried maltodextrin. Foam dried maltodextrin has a honeycomb effect which gives it a significantly reduced bulk density. Thus, preferably a maltodextrin that is fluffy and light is used.

Preferably, the product comprises granulated sugar in the range of 60–90% by weight, more preferably 75–85% by weight, maltodextrin 10–40% by weight more preferably 15–25% by weight and sweetener, typically aspartame and/or acesulfame K, 0.1–1.0% by weight more preferably 0.1–0.5% by weight. Preferably, about 0.4% sweetener or about 0.2% each of aspartame and acesulfame K is used. Preferably about 0.18 to 0.22% each of aspartame and acesulfame K is used.

According to a still further aspect of the present invention there is provided a method of producing a granulated sugar product comprising mixing granulated sugar, maltodextrin and high intensity sweetener in such a manner as to result in agglomeration of the mixture. Preferably, the components of the mixture are as described above. Preferably, the mixing is by means of a low shear mixer or slow speed blender. Alternatively, a batch or continuous agglomerator may be used. Preferably, liquid, typically water, is added to the mixture during mixing. The liquid may be added by spraying atomised liquid onto the mixture.

Preferably, the mixture is mixed in a low shear mixer and a small amount of liquid, typically water, is added. As a specific example, 50 ml to 3.0 liters water may be added to an approximately 60 kg mixture. This results in the even and permanent agglomeration of the mixture with all of or some of the aforementioned characteristics. The low shear mixer may be of any suitable type such as drum types, tote blenders or slow speed blenders.

Alternatively, the mixture may be added to a batch or continuous agglomerator such as a fluidised bed agglomerator. Such an agglomerator may comprise a vessel having an air distribution grate at a lower end thereof. One or more filters may be positioned at an upper end of the vessel to filter out entrained solids. Nozzles for spraying atomised liquids, typically water, may be positioned in, on or adjacent to the vessel, for example in the sides or top of the vessel. Preferably, a small amount of sugar is added to the liquid or water in either embodiment before it enters the mixer or agglomerator as it has been found that this gives better results.

Preferably, the mixer or blender is as described above and is operated as described above.

According to another aspect of the invention there is provided a method of producing a granulated sugar product comprising the steps of:

(i) adding granulated sugar, starch or hydrolysis products thereof and high intensity sweetener to a low shear mixer or slow speed blender having at least two driving shafts, the shafts being provided with blades arranged at an angle to and parallel with the shafts; and (ii) operating the mixer or blender such that the shafts rotate in opposite directions.

Preferably, the mixer or blender is as described above and is operated as described above.

Preferably, the starch or hydrolysis product thereof is a low bulk density material. Preferably, the hydrolysis product of starch is maltodextrin. The method may include adding liquid or other method steps described herein. The sugar, maltodextrin and sweetener may be as described herein.

The invention further includes a method of producing a granulated sugar product of the invention and a product produced by means of a method of the invention.

BRIEF DESCRIPTION OF THE DRAWINGS

The invention will now be described further by way of example only, and with reference to the accompanying drawings and examples in which.

DETAILED DESCRIPTION OF THE INVENTION

Figure 1:
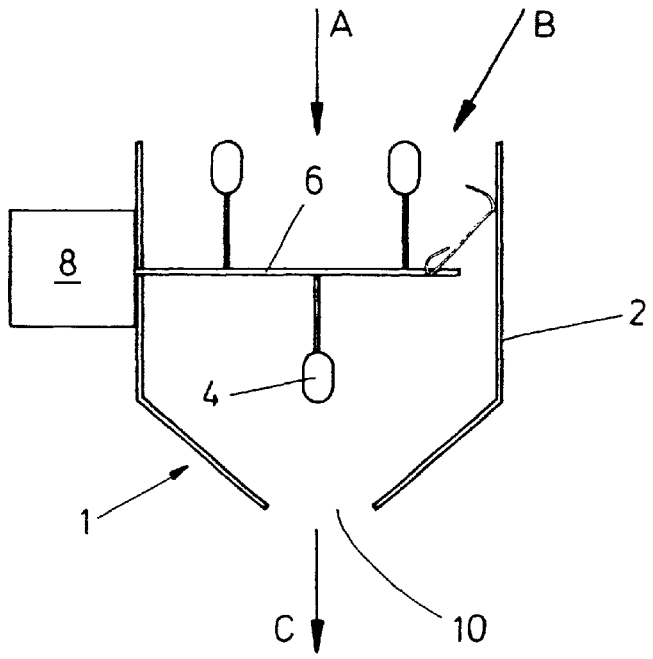
FIG. 1 is a schematic view showing use of a low shear mixer in the method of the invention.

Referring to FIG. 1 granulated sugar, maltodextrin and aspartame/acesulfame K are added as shown schematically by arrow A, in powder form to a low shear mixer or slow speed blender 1 comprising an open topped vessel 2 having mixing blades or paddles 4 located therein. The blades are mounted on a driving shaft 6 which is rotated by motor means 8 so that the blades move slowly. It is preferable that on certain mixers the rotation is reversed to that of conventional operation. In normal operation on certain mixers such as that described in U.S. Pat. No. 4,278,355 the two shafts turn towards each other with upward movement on the side where the shafts turn toward each other so that the paddles take the product and mix them at the top of the vessel where these two sets of paddles meet. It is preferable for the invention that the two shafts turn toward each other with downward movement on the side where the shafts turn toward each other and that the mixing takes place at the bottom of the machine where the paddles meet. It will be appreciated that any suitable low shear mixer or slow speed blender may be used and for example, a ribbon or screw mixing means may be used instead of blades 4 and shaft 6. Although ribbon mixing means are normally run at high speed such means could be run slowly for the purpose of the present invention.

While or after the powders are added, liquid such as water is added typically while the blades are moving. This is illustrated by arrow B. As the mixture is mixed, the mixture agglomerates and the resultant product is output via a suitable outlet 10 on the vessel 2, as shown by arrow C.

Figure 2:
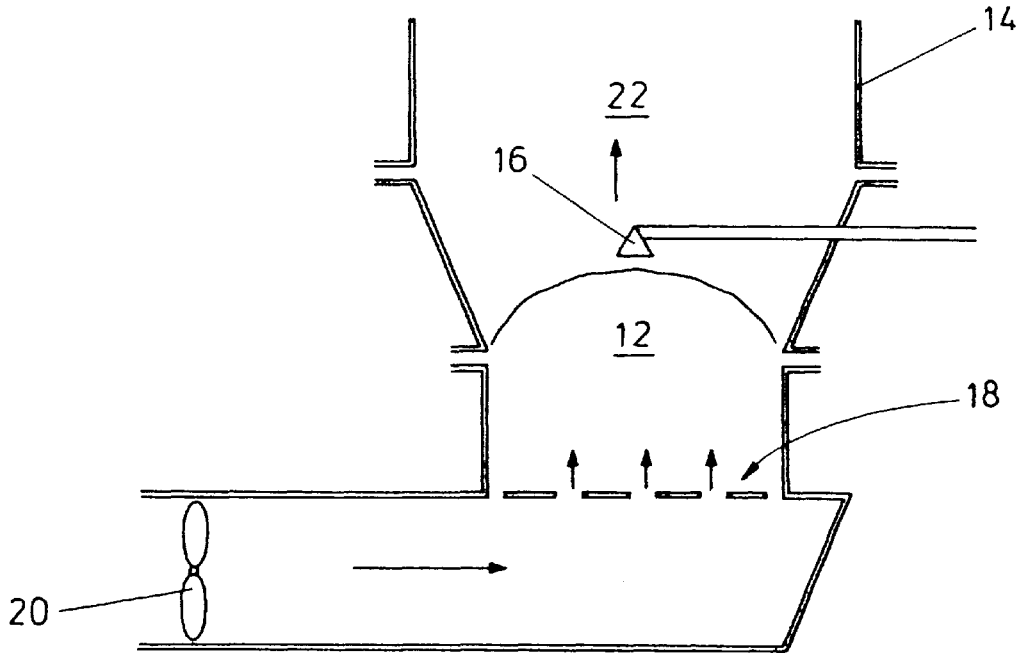
FIG. 2 is a schematic view showing use of a fluidised bed agglomerator in the method of the invention.

Referring to FIG. 2, the mixture 12 is added to a fluidised bed agglomerator comprising an open topped vessel 14. Liquid is sprayed into the vessel via one or more nozzles 16 located in or on the vessel. Typically the nozzles 16 are designed to atomise the liquid. The base of the vessel 14 comprises a mesh plate 18 and the vessel is connected to an air supply or fan 20 so that, in use, air passes up through the mesh plates, through the mixture and out through the filters 22 located at the top of the vessel 14.

It has been found that a product of the invention or produced using a method of the invention has one or more of the aforementioned desired characteristics and is cost effective to produce.

Method of Preparation

Load a mixing, machine as described in U.S. Pat. No. 4,278,355 with reference to FIGS. 1 to 3 thereof with 28.30 kg (sucrose) sugar or ground oversize plus 0.079 g each of aspartame and acesulfame K. Start the machine at full speed. Add a wet mix of sucrose sugar (2.70 kg) and water (0.75 kg) and mix for 45 seconds. Stop the machine. Add 5.000 kg sugar followed by 7.67 kg maltodextrin (foam dried). Mix for 10 seconds on full speed and discharge into bin. Transfer to Calmic container and gently mix. Sieve through 2 m—m screen, keeping the load on the screen low. If the bulk density starts to increase, the amount of water in the wet mix may be increased by 50 ml at a time until the required bulk density is obtained. It is preferred that the mixing machine is operated such that the shafts rotate in opposite directions with downward movements on the side where the shafts turn toward one another so that the mixing zone lies below the level of the shafts in contrast to the mixing method described with reference to FIG. 4 of U.S. Pat. No. 4,278,355.

The above procedure produces a maximum bulk density of 0.38 g/cc.

It will be appreciated that the present invention is not intended to be restricted to the details of the above embodiments which are described by way of example only.

What is claimed is:

1. A granulated sugar product comprising a core material of a granulated first sugar material and a surface material of a second sugar material having lower bulk density than the first sugar material, wherein the first sugar material has a bulk density in the range of 0.60–1.20 g/cm$^3$ and the second sugar material is foam dried and has a bulk density in the range of 0.01–0.55 g/cm$^3$.

2. The granulated product according to claim 1, wherein the density of the first sugar material is in the range of 0.8–1.0 g/cm$^3$ and the density of the second sugar material is in the range of 0.10–0.20 g/cm$^3$.

3. The granulated product according to claim 1, wherein the second sugar material comprises a honeycomb effect.

4. The granulated sugar product according to claim 1, wherein the surface material covers at least a part of a surface of a first sugar granule.

5. The granulated sugar product according to claim 1, wherein the product comprises a high intensity sweetener.

6. The granulated sugar product according to claim 1, wherein the first sugar material is sucrose.

7. The granulated sugar product according to claim 1, wherein the second sugar material is selected from a group consisting of sucrose, glucose, anhydrous dextrose, mono dextrose, fructose, anhydrous lactose, hydrated lactose, maltose, Ribose, galactose, dextrins, dried glucose syrups, sorbitol, mannitol, grape sugar, arabinose, raffinose, mannose, starch, cellulose, inulin, glycogen, xylitol, levoglucason, rhamnose, maltol, ethyl derivative of maltol, iso-maltose, gentobiose, trehalose, cellobiose, neohesperidose, maltrotriose, parose, neokestose, and stachyose.

8. The granulated sugar product according to claim 6, wherein the second sugar material is selected from a group consisting of sucrose, glucose, anhydrous dextrose, mono dextrose, fructose, anhydrous lactose hydrated lactose, maltose, Ribose, galactose, dextrins, dried glucose syrups, sorbitol, mannitol, grape sugar, arabinose, raffinose, mannose, starch, cellulose, inulin, glycogen, xylitol, levoglucason, rhamnose, maltol, and ethyl derivative of maltol, iso-maltose, gentobiose, trehalose, cellobiose, neohesperidose, maltrotriose, parose, neokestose, and stachyose.

9. The granulated sugar product according to claim 5, wherein the high intensity sweetener is selected from a group consisting of sorbitol, mannitol, isomalt, maltitol, lactitol, xylitol, acesulfame k, aspartame, cyclamic acid and its sodium and calcium salts, saccharin and its sodium, potassium and calcium salts, thaumatin, and neohesperidine DC.

10. The granulated sugar product according to claim 8, wherein the high intensity sweetener is selected from a group consisting of sorbitol, mannitol, isomalt, maltitol, lactitol, xylitol, acesulfame k, aspartame, cyclamic acid and its sodium and calcium salts, saccharin and its sodium, potassium and calcium salts, thaumatin, and neohesperidine DC.

11. The granulated sugar product according to claim 10, wherein the second sugar material comprises maltodextrin.

12. The granulated sugar product according to claim 1, wherein the product comprises the first sugar material in the range of 60–90% by weight.

13. The granulated sugar product according to claim 1, wherein the product comprises the second sugar material in the range of 10–40% by weight.

14. The granulated sugar product according to claim 5, wherein the product comprises the high intensity sweetener in the range of 0.1–1.0% by weight.

15. The granulated sugar product according to claim 9, wherein the product comprises the sweetener in the range of 0.1–1.0% by weight.

16. A method of producing a granulated sugar product comprising mixing a core material of a granulated first sugar material having a bulk density in the range of 0.60–1.20 g/cm$^3$ and a surface material of a second sugar material that is foam dried and has a bulk density in the range of 0.01–0.55 g/cm$^3$ in such a manner as to result in agglomeration of mixture.

17. The method of producing a granulated sugar product according to claim 16, wherein mixing is provided by means of a mixing machine comprising a mixing chamber in which two shafts are arranged in a substantially same horizontal plane, the shafts being provided with blades or paddles disposed at an angle to and parallel with the shafts, the shafts rotating m opposite directions.

18. The method of producing a granulated sugar product according to claim 17, wherein the mixing machine is operated such that downward movements are on the side where the shafts turn toward one another.

19. The method of producing a granulated sugar product according to claim 18, wherein a plurality of opposing pairs of blades of certain area are mounted on each shaft, positioned 90° transverse of a centerline for the shafts and with blade wings disposed at a 45° angle in relation to the shaft centerline.

20. A method of producing a granulated sugar product comprising the steps of:

(i) adding a core material of a granulated first sugar material having a bulk density in the range of 0.60–1.20 g/cm$^3$ and a surface material of a second sugar material that is foam dried and has a bulk density in the range of 0.01–0.55 g/cm$^3$ to a low shear mixer or slow speed blender having at least two driving shafts, the shafts being provided with blades arranged at an angle to and parallel with the shafts;

(ii) operating the mixer or blender such that the shafts rotate in opposite directions so as to produce a granulated sugar product having an overall bulk density before packing in the range of 0.10–0.65 g/cm$^3$; and (iii) packing the product so that the overall bulk density of the granulated sugar product after packing is in the range of 0.20–0.90 g/cm$^3$.

21. A method according to claim 1, wherein the shafts of the mixer or blender are disposed in substantially the same horizontal plane and the mixer or blender is operated such dial downward movement of the shafts is on a side where the shafts turn toward one another.

22. The granulated sugar product according to claim 1, wherein the overall bulk density of the granulated sugar product before packing is in the range of 0.10–0.65 g/cm$^3$.

23. The granulated sugar product according to claim 1, wherein the reduction in calories per unit volume of the granulated sugar product with respect to traditional sugar is in the range of 5–60%.

* * * * *